US005620336A

United States Patent [19]

Worthing

[11] Patent Number: 5,620,336

[45] Date of Patent: Apr. 15, 1997

[54] CABLE RETAINER FOR ELECTRIC CABLE

[75] Inventor: John Worthing, Birtley, United Kingdom

[73] Assignee: Black & Decker Inc., Newark, Del.

[21] Appl. No.: 557,632

[22] Filed: Nov. 14, 1995

[30] Foreign Application Priority Data

Nov. 15, 1994 [GB] United Kingdom ..... 9423005

[51] Int. Cl.[6] ..... H01R 13/72

[52] U.S. Cl. ..... 439/501; 439/371; 248/52; 199/12 R

[58] Field of Search ..... 439/456, 459, 439/449, 577, 501, 371; 15/410; 248/52; 191/12 R

[56] References Cited

U.S. PATENT DOCUMENTS

| | | | |
|---|---|---|---|
| 4,062,430 | 12/1977 | Momberg | 191/12 R |
| 4,875,879 | 10/1989 | Bunyea et al. | 439/501 |
| 5,318,158 | 6/1994 | Seasholtz | 439/501 |
| 5,326,283 | 7/1994 | Chen | 439/501 |
| 5,330,138 | 7/1994 | Schlessmann | 248/52 |

FOREIGN PATENT DOCUMENTS

| | | |
|---|---|---|
| 0035099 | 1/1981 | European Pat. Off. . |
| 0600736 | 6/1994 | European Pat. Off. . |
| 9317077 | 2/1994 | Germany . |
| 9411304 | 9/1994 | Germany . |
| 2257916 | 10/1989 | Japan . |

OTHER PUBLICATIONS

Photos of WeedEater VIP Twist 'N Edge Catalog No. TE35 String Trimmer, sold in the U.S. more than one year before the priority date of the present application.

*Primary Examiner*—Gary F. Paumen

*Attorney, Agent, or Firm*—Charles E. Yocum; Dennis A. Dearing; John D. Del Ponti

[57] ABSTRACT

A cable retainer (6) for retaining an electric power cable (26) for a portable electrical appliance (10) comprises a substantially L-shaped hook member (8). The substantially L-shaped hook member (8) comprises two arms (16,22), the first of which arms (16) is secured to the wall (14) of the appliance (10) within an aperture (12) formed in the wall (14), the securing point (20) being located in the wall of the aperture and the second of which arms (22) is a return arm and extends into the body (24) of the appliance (10). The cable retainer is particularly suitable for use on a portable electric appliance such as a grass trimmer, a hedge clipper or a vacuum cleaner.

9 Claims, 2 Drawing Sheets

CABLE RETAINER FOR ELECTRIC CABLE

BACKGROUND OF THE INVENTION

The present invention relates to a power cable retainer for a portable electrical appliance, in particular for a portable electric appliance such as a grass trimmer, a hedge clipper or a vacuum cleaner.

A number of proposals have been made for power cable retainers of this type, but known designs suffer from one or more disadvantages. They may, for example, be expensive to manufacture, there may be restrictions on the position in which the retainer can be located, they may detract from the industrial design of the product or a particular retainer may only be suitable for use with a specific diameter cable, so that the appliance manufacturer has to provide a range of differently sized retainers for cables whose diameters may only differ by a small amount.

SUMMARY OF THE INVENTION

It is an object of the present invention to provide a cable retainer in which the above disadvantages are reduced or substantially obviated.

The present invention therefore provides a cable retainer for retaining an electric power cable for a portable electrical appliance, characterised in that the cable retainer comprises a substantially L-shaped hook member, comprising two arms, the first of which arms is secured to the wall of the appliance within an aperture formed in the wall, the securing point being located at the base of the aperture in the normal operating orientation of the appliance and the second of which arms is a return arm and extends into the body of the appliance.

In a preferred embodiment of a cable retainer according to the invention, the aperture is substantially circular in shape. The length of the first arm is preferably equal to or greater than the maximum intended cable diameter, and the length of the return arm is preferably equal to or greater than the maximum intended cable radius.

In a further preferred embodiment of a cable retainer according to the invention, the junction between the first arm and the return arm is curved with an internal radius.

The present invention further provides a portable electrical appliance which comprises a cable retainer for retaining an electric power cable, characterised in that the cable retainer comprises a substantially L-shaped hook member, comprising two arms, the first of which arms is secured to the wall of the appliance within an aperture formed in the wall, the securing point being located at the base of the aperture in the normal operating orientation of the appliance and the second of which arms is a return arm and extends into the body of the appliance.

It is particularly preferred that the portable appliance is a grass trimmer, in particular a grass trimmer of the type which comprises a rotary cutter, in particular a filament, which, in use, rotates about an axis which is substantially horizontal with respect to the ground. Where the appliance is a grass trimmer, it is particularly preferred that the cable retainer should be located as far away as possible from the cutter, preferably in the main handle of the trimmer, in the end wall thereof.

BRIEF DESCRIPTION OF THE INVENTION

An embodiment of a cable retainer according to the invention will now be further described with reference to the accompanying drawings in which.

DETAILED DESCRIPTION OF THE INVENTION

Figure 1:
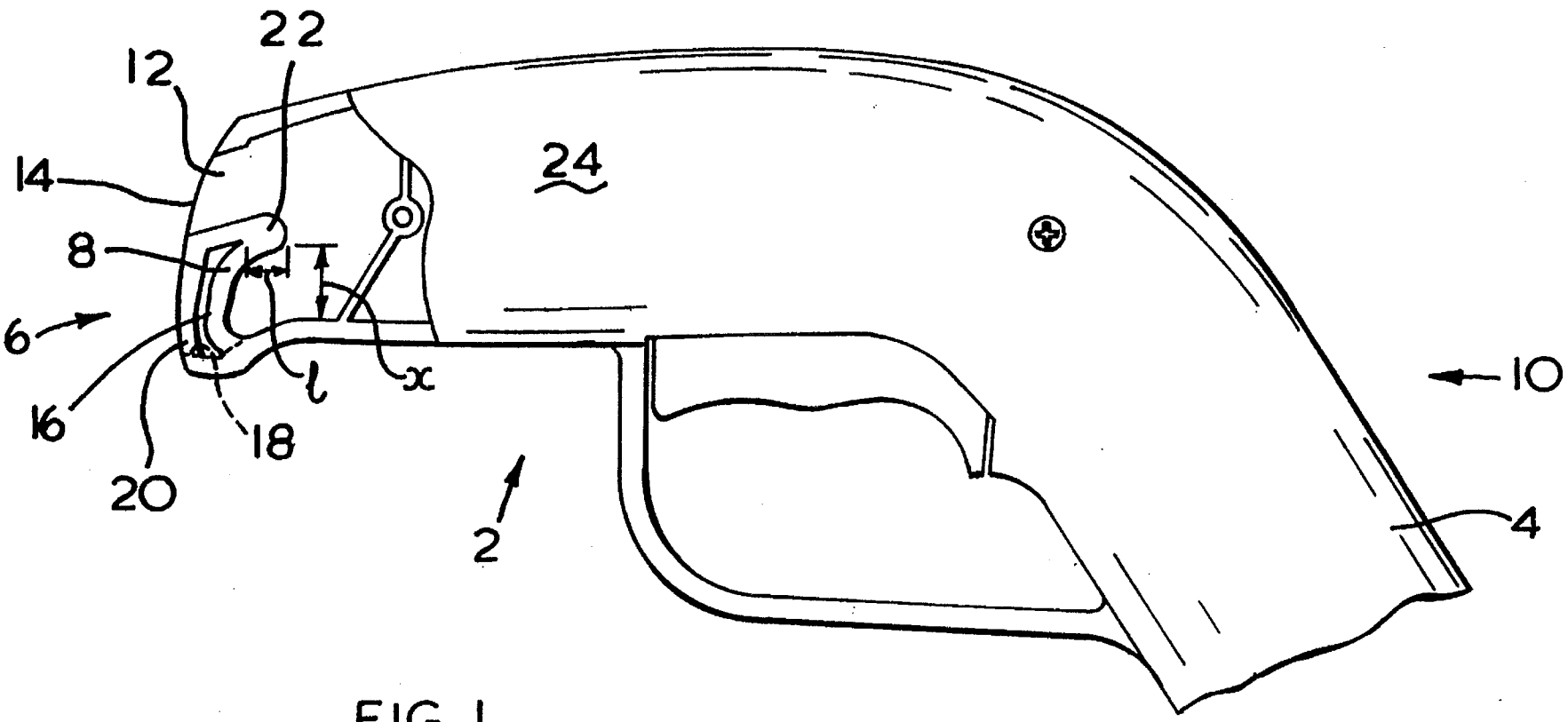
FIG. 1 is a longitudinal section through the handle section of a grass trimmer.

As can be seen, a string trimmer 10 comprises a handle 2 of clam shell construction, two mating clamshells 4,4' comprising the handle section 2. A cable retainer shown generally at 6 comprises a hook member 8. The hook member 8 is generally L-shaped and is located in an aperture 12 in the end wall 14 of the handle 2 of the trimmer 10. The hook member 8 comprises a first arm 16 secured to the lower edge 18 of the aperture 12 at securing point 20 and a second, return arm 22 which projects into the body 24 of the trimmer 10.

Figure 2:
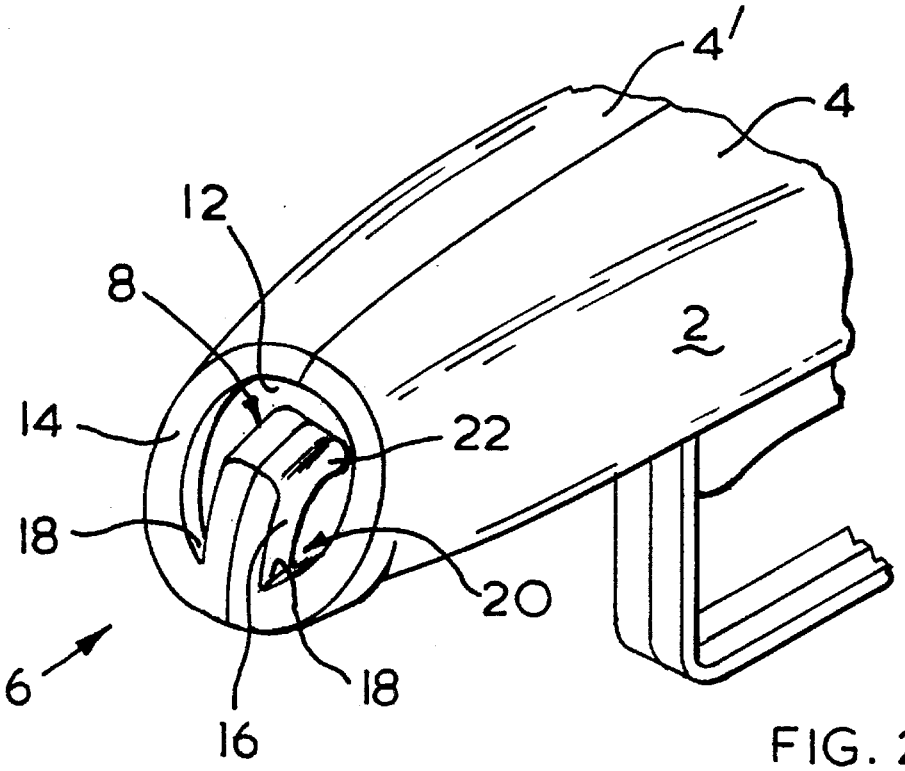
FIG. 2 is a perspective view of a handle section of a grass trimmer.
Figure 3:
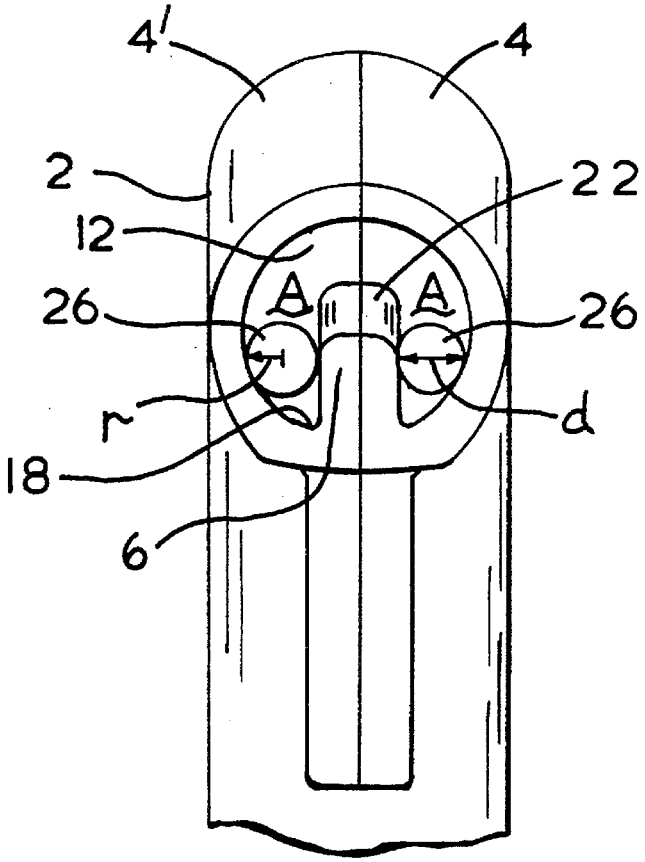
FIG. 3 is a view of the end wall of the handle section of the grass trimmer.

In use, a cable 26 is inserted into the aperture 12 and looped around the hook member 8. As can be seen from FIG. 1, the length 1 of the return arm 22 is greater than the radius r of the cable 26 and the length x of the first arm 16 is greater than the diameter d of the cable 26. As can be seen from FIG. 2, the aperture 12 is substantially circular so that the area A available for the cable tapers to accommodate different sizes of cable, depending on the depth to which the cable is inserted.

I claim:

1. A cable retainer (6) for retaining an electric power cable (26) for a portable electrical appliance (10), characterised in that the cable retainer (6) comprises a substantially L-shaped hook member (8), comprising two arms (16,22), the first of which arms (16), is secured to the wall (14) of the appliance (10) within an aperture (12) formed in the wall (14), the securing point (20) being located in the wall of the aperture and the second of which arms (22) is a return arm and extends into the body (24) of the appliance (10).

2. A cable retainer according to claim 1 characterised in that the securing point (20) is located in the base of the aperture in the normal operating orientation of the appliance (10).

3. A cable retainer according to claim 1 characterised in that the aperture (12) is substantially circular in shape.

4. A cable retainer according to claim 1 characterised in that the length of the return arm (22) is equal to or greater than the maximum intended cable radius.

5. A cable retainer according to claim 1 characterised in that the length of the first arm (16) is equal to or greater than the maximum intended cable diameter.

6. A cable retainer according to claim 1 characterised in that the junction between the first arm (16) and the return arm (22) is curved with an internal radius.

7. A portable electrical appliance characterised in that it comprises a cable retainer according to claim 1.

8. A portable electrical appliance according to claim 1 characterised in that the appliance is a grass trimmer.

9. A portable electrical appliance according to claim 8 characterised in that the cable retainer is located in a wall of a primary handle of the grass trimmer.

* * * * *